US006308638B1

(12) United States Patent
Pease

(10) Patent No.: US 6,308,638 B1
(45) Date of Patent: Oct. 30, 2001

(54) WHEEL STOP FOR AN OVERHEAD VEHICLE

(75) Inventor: Ronald Pease, Hickory Hills, IL (US)

(73) Assignee: Western-Cullen-Hayes, Inc., Chicago, IL (US)

( * ) Notice: Subject to any disclaimer, the term of this patent is extended or adjusted under 35 U.S.C. 154(b) by 0 days.

(21) Appl. No.: 09/617,375

(22) Filed: Jul. 17, 2000

Related U.S. Application Data

(62) Division of application No. 09/076,506, filed on May 12, 1998, now Pat. No. 6,155,178.
(60) Provisional application No. 60/083,907, filed on May 1, 1998.

(51) Int. Cl.[7] ..... B61K 7/00
(52) U.S. Cl. ..... 104/252; 104/257
(58) Field of Search ..... 104/249, 250, 104/251, 252, 257, 258, 260; 188/33, 35, 36, 37, 38, 41, 45

(56) References Cited

U.S. PATENT DOCUMENTS

| | | | | |
|---|---|---|---|---|
| 998,638 | | 7/1911 | Rink | 104/257 |
| 1,850,446 | * | 3/1932 | Camerota | 104/252 |
| 2,067,694 | * | 1/1937 | Clarke | 104/257 |
| 2,175,286 | * | 10/1939 | Finch | 104/258 |
| 2,207,329 | | 7/1940 | Nelms | 104/257 |
| 2,569,858 | | 10/1951 | Kirtner et al. | 104/257 |
| 3,332,358 | * | 7/1967 | Thomas et al. | 104/251 |
| 3,897,735 | * | 8/1975 | Watts | 104/166 |
| 5,562,041 | * | 10/1996 | Ellens | 104/251 |

FOREIGN PATENT DOCUMENTS

| | | | |
|---|---|---|---|
| 2043007 | 10/1980 | (GB) | 104/257 |

* cited by examiner

*Primary Examiner*—Mark T. Le
(74) *Attorney, Agent, or Firm*—Banner & Witcoff, Ltd.

(57) ABSTRACT

A wheel stop for an overhead rail vehicle includes a wheel block assembly pivotably fastened to a clamping assembly. The wheel block assembly is provided with an actuator connector positioned such that a downward force on the wheel block assembly tends to move the wheel block assembly from a wheel-engaging position to a retracted position. An actuating assembly permits an operator to actuate a lift rod for moving the wheel block assembly from a ground location. Shock absorbing elements on the wheel stop prevent damage. The actuating assembly is provided with apertures for receiving a padlock to prevent tampering.

11 Claims, 6 Drawing Sheets

200
252
264
12
250
268
270
220
218
14
230
232
234
24
216
266
104
22
212
240
242
244
110
112
20
350

350
16
320
318
316
304
106
324
306
330
322
328
308
326
300
302
314
312
310

WHEEL STOP FOR AN OVERHEAD VEHICLE

CROSS-REFERENCE TO RELATED APPLICATION

This application is a divisional application of U.S. patent application Ser. No. 09/076,506 filed May 12, 1998, now U.S. Pat. No. 6,155,178 issued on Dec. 5, 2000.

Applicant claims priority for this application under 35 U.S.C. § 119(e) based on provisional application No. 60/083,907 entitled "WHEEL STOP FOR AN OVERHEAD VEHICLE." filed on May 1, 1998.

FIELD OF THE INVENTION

The invention relates generally to devices for preventing movement of vehicle on a rail. Specifically, the invention relates to devices which permit an operator to selectively prevent movement of a vehicle on an overhead rail.

BACKGROUND OF THE INVENTION

Wheel stops are used widely in rail transportation systems for safety purposes. For example, as disclosed in U.S. Pat. Nos. 3,420,190 and 229,100, portable wheel stops for overhead cranes provide a means for engaging the wheels of an overhead crane to prevent movement of the crane past a certain point on the rail. Such portable crane stops are required by OSHA regulations which mandate that cranes on overhead rails which are in operation on the same runway shall be isolated by rail stops or other suitable means to prevent interference with an idle crane. These known devices are provided as portable units which require a operator to be located at an overhead position. Such devices do not permit selective engagement or disengagement safely from a ground location.

It would therefore be desirable to provide a wheel stop device for an overhead vehicle which facilitates actuation from a ground location and which offers enhanced safety and manufacturing features compared to prior art devices. It would also be desirable to provide a wheel stop system which includes an actuator that is operable from a ground location.

SUMMARY OF THE INVENTION

The present invention contemplates a new and improved wheel stop for an overhead vehicle that overcomes the above mentioned problems and others and provides a safe dependable device for selectively prohibiting the movement of an overhead rail vehicle. In accordance with the present invention, a wheel stop is provided with a base for securing the wheel stop to a rail and the pivotable wheel block assembly connected thereto. The wheel block assembly is provided with an actuator connector positioned on the wheel block assembly such that a downward force on the actuator connector tends to move the wheel block assembly from a wheel engaging position towards a retracted position.

In accordance with another aspect of the invention, an actuator assembly is provided for cooperating with the wheel block assembly to permit an operator to move the wheel block assembly from a wheel engaging position to a retracted position from a ground location.

A principal advantage of the invention is that it provides a wheel stop that may be disengaged from its wheel-engaging position with a downward force on the wheel block assembly. Another principal advantage of the invention is a wheel stop that permits an operator to move the wheel block assembly with an actuator disposed at a ground location. Yet another advantage of the invention is that it permits a wheel stop assembly to be mounted on either a right or left handed orientation on an overhead rail system without requiring separate right and left hand configurations of the wheel stop assembly and actuator. Still another advantage of the invention is that it provides a wheel stop assembly which is protected against damage by shock absorbing elements.

Other advantages novel features, and the further scope of applicability of the present invention will be set forth in the detailed description to follow, taken in conjunction with the accompanying drawings, and in part will become apparent to those skilled in the art upon examination of the following, or may be learned by practice of the invention. The advantages of the invention may be realized and attained by means of the instrumentalities and combinations particularly pointed out in the appended claims.

BRIEF DESCRIPTION OF THE DRAWINGS

The accompanying drawings which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings, in which like numbers refer to like parts throughout.

DETAILED DESCRIPTION OF THE PREFERRED EMBODIMENTS

Figure 1:
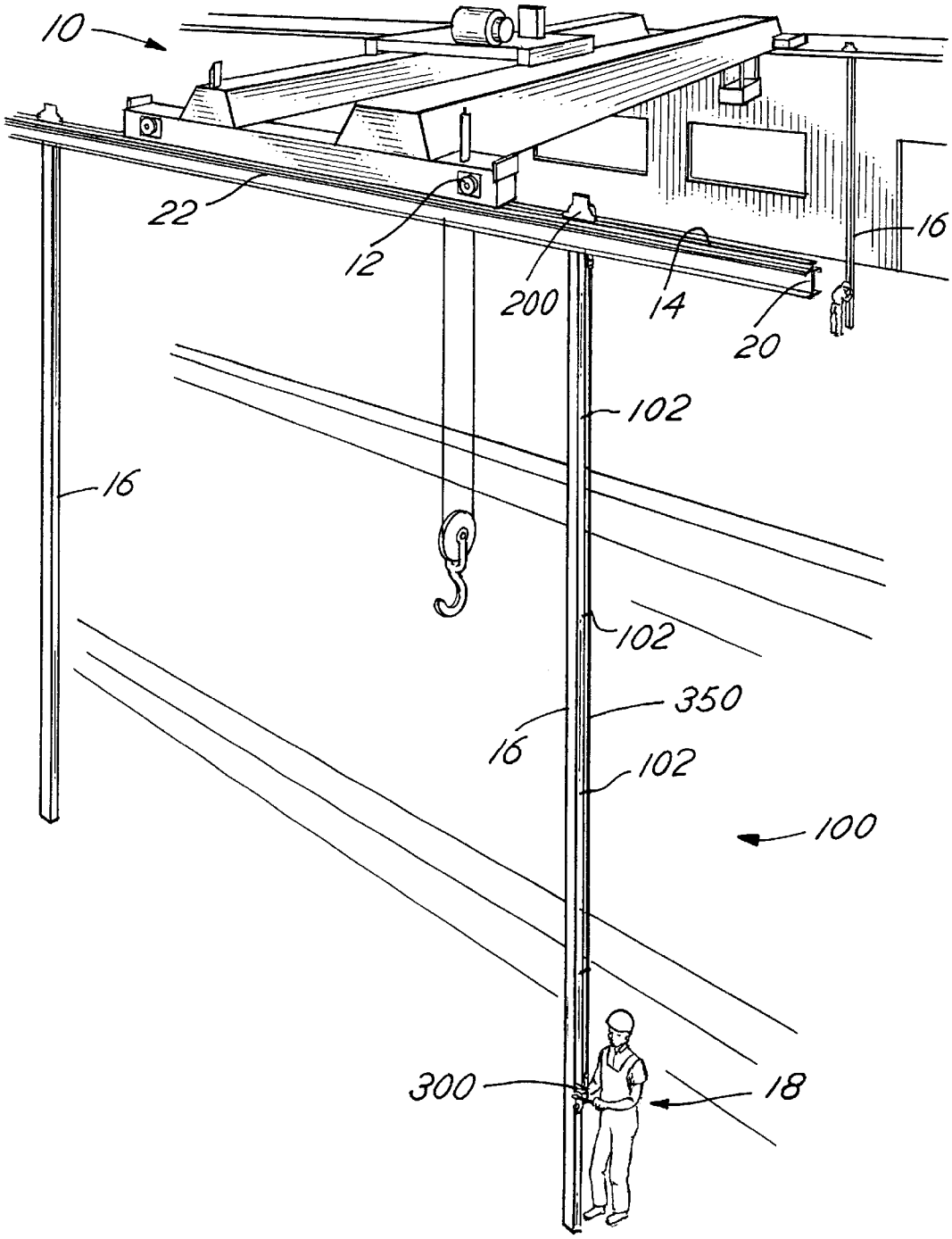
FIG. 1 is an isometric showing an apparatus according to a preferred embodiment of the present invention in a typical overhead rail system.

Referring now to the drawings wherein the showings are for the purposes of illustrating the preferred embodiment and invention only and not for purposes of limiting the same, the FIGURES show an overhead crane assembly 10, including a wheel stop 200 which is actuated using an actuator assembly 300.

Figure 2:
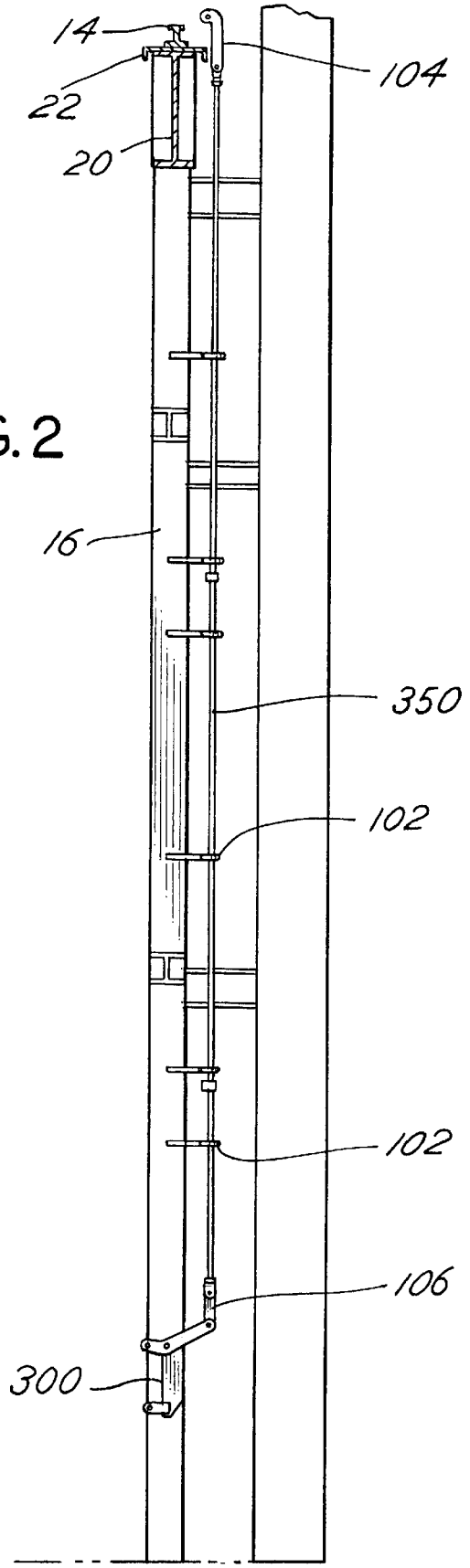
FIG. 2 is a partial, section showing a side of an actuator assembly in accordance with a preferred Embodiment of the present invention.

Turning particularly to FIGS. 1 and 2, an overhead vehicle 10, which may be an overhead crane, includes a plurality of wheels 12 which are situated to run on a pair of overhead rails 14. Vehicle 10 extends across a two-rail system as illustrated including a second rail disposed in the background. Rails 14 are supported above the ground by support columns 16.

In accordance with the present invention, a wheel stop assembly 100 is disposed on one of the support columns 16. Wheel stop assembly 100 includes the wheel stop 200, an actuating assembly 300, and a lift rod 350 cooperating therebetween. Actuating assembly 300 enables an operator 18 to actuate the wheel stop 200 from a ground location. The details of the wheel stop 200 and actuating assembly 300 will be explained below.

Referring additionally to FIG. 2, there is illustrated a side view of the lift rod 350 and support column 16. As is known in the art, rail 14 is supported on a rail support channel 22 which is, in turn, supported on a rail support web 20 situated on the top of column 16. Lift rod 350 is movably supported within a plurality of lift rod guides 102 which are fastened to support column 16. Lift rod guides 102 permit vertical movement of lift rod 350. A lower pivot link 106 cooperates with the actuating assembly 300 and is fastened to lower end of the lift rod 350 in a manner that will be described in more detail below. An upper end of the lift rod 350 is provided with an upper pivot link 104 which cooperates with the wheel stop 200 (not shown in FIG. 2).

Figure 3:
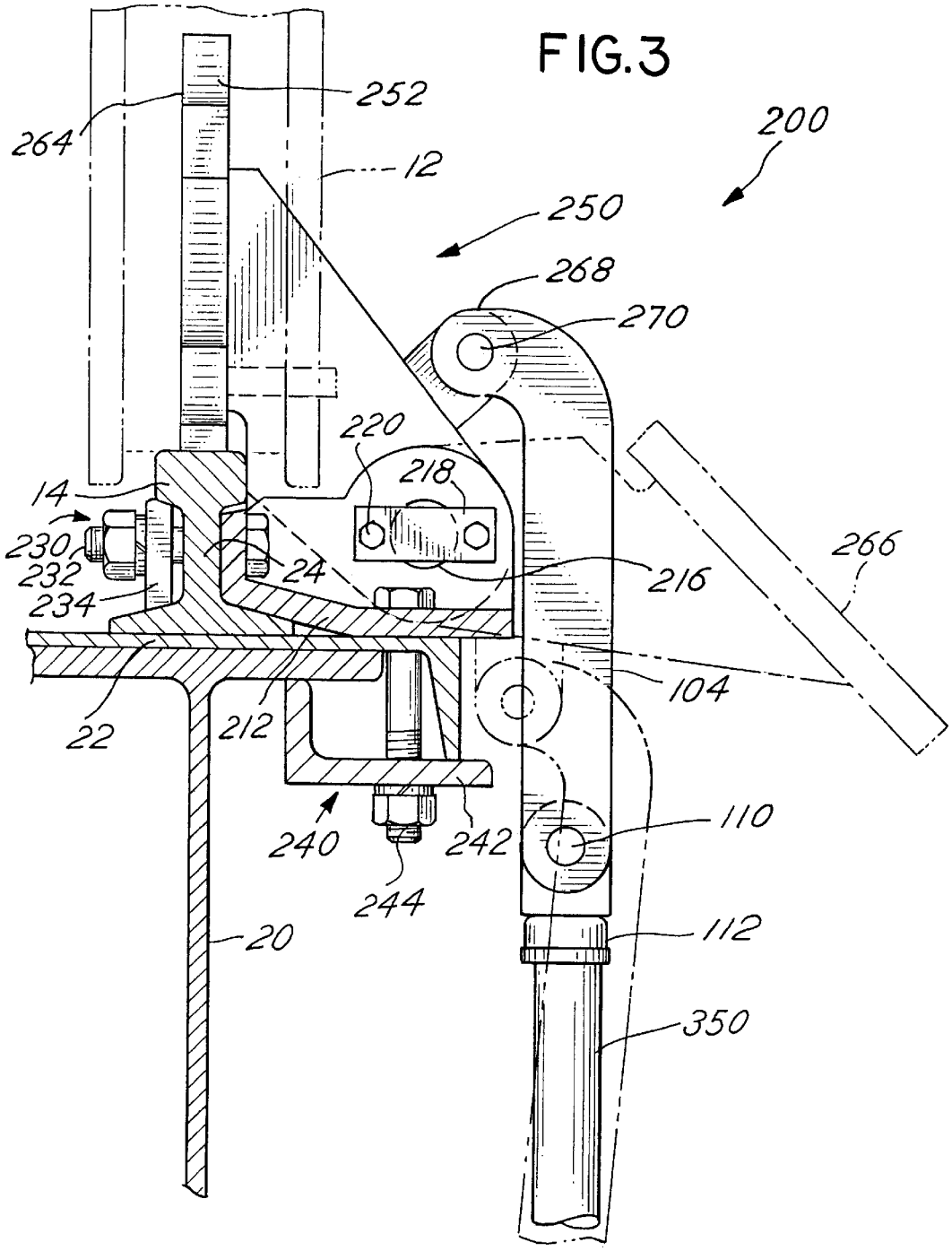
FIG. 3 is a side view of a wheel stop assembly according to a preferred embodiment of the present invention.

Referring now to FIG. 3, there is illustrated a side view of a wheel stop 200 in accordance with a preferred embodiment of the invention. Wheel stop 200 is generally comprised of a wheel block assembly 250 and a base assembly 210 which is affixed to the rail 14 and the rail support channel 22 and rail support web 20.

Figure 4:
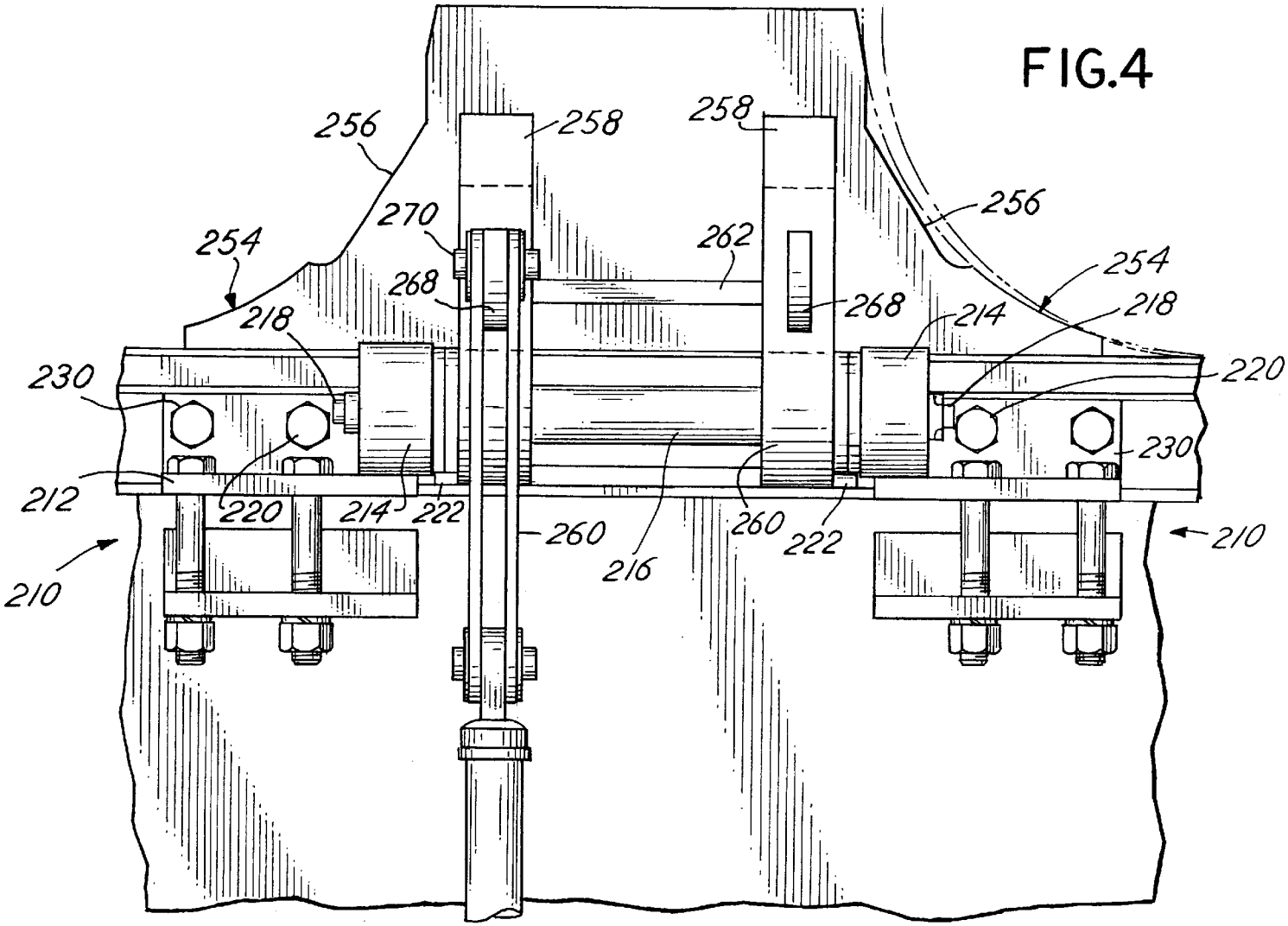
FIG. 4 is a front view of a wheel stop assembly according to a preferred embodiment of the present invention.

Base assembly 210 includes a base plate 212 which has affixed thereto a pair of pivot shaft journals 214. Referring additionally to FIG. 4, a wheel stop pivot shaft 216 is retained within the journals 214. Outer ends of the pivot shaft journals 214 are provided with pivot shaft retainers 218 which secure the wheel stop pivot shaft 216 against lateral movement therein. Pivot shaft retainers 218 may be secured to the pivot shaft journals 214 using conventional fasteners which may be threaded screws 220.

Base assembly 210 is secured to the rail 14 using a rail clamp assembly 230. Rail clamp assembly 230 includes a rail clamp fastener 232 which may be a threaded nut and bolt arrangement provided in a hole (not illustrated) drilled through the rail web 24. In a similar fashion a hole (not illustrated) is provided through base plate 212 to permit insertion of Fe rail clamp fastener 232. On a side opposite base plate 212 there is provided a rail clamp plate 234 shaped to fit in a complimentary fashion within the rail profile to provide a clamping configuration as fastener 232 is tightened. Base plate 212 is also secured to the rail support channel 22 and rail support web 20 using a channel clamp assembly 240. Channel clamp assembly 240 includes a channel clamp 242 which may be an angled bracket provided with a through hole to receive a threaded channel clamp fastener 244. Base plate 212 is provided with another through hole to receive channel clamp fastener 244. As can be seen from FIG. 3, channel clamp assembly 240 provides additional clamping force to secure base plate 212 to the rail support web and rail support channel. As can be seen in FIG. 4, wheel stop 200 is provided with a symmetrical design which includes a base assembly 210 and base plate 212 on each side.

Referring still to FIGS. 3 and 4, wheel block assembly 250 is pivotably secured to the base assembly 210 via wheel stop pivot shaft 216. Wheel block assembly 250 includes a wheel block 252 which is provided with a wheel engaging surface 254 which is shaped complimentary to the periphery of the wheel 12. A recess 256 is provided in the profile of the wheel block 252. The function of recess 256 is to cause the wheel and the vehicle 10 to elevate somewhat after initial engagement of the wheel with the wheel engaging surface 254. Wheel block assembly 250 includes a pair of flanges 258 which are fastened to the wheel block 252 by welding or other suitable means. Flanges 258 extend in a generally perpendicular fashion from the wheel block 252 and are provided with respective wheel block journals 260 at ends disposed opposite of the wheel block 252. Wheel block journals house the wheel stop pivot shaft 216 and therefore permit the wheel block to pivot about wheel stop pivot shaft 216. A cross member 262 is provided between the flanges 258 for reinforcement.

Referring particularly to FIG. 3, wheel block 252 may move from a wheel engaging position 264 to a retracted position shown in phantom 266. In accordance with one advantage of the invention, an actuator connector 268 is provided in the form of a pivot link lug which includes a central journal adapted to receive a pivot pin 270. In accordance with this aspect of the invention, actuator connector 268 is positioned on the wheel block assembly 250 in such a fashion that a downward force on the actuator connector tends to move the wheel block assembly from the wheel engaging position 264 to the retracted position 266. As will be evident from FIG. 3, in the described embodiment, the invention may be seen to reside in the placement of the pivot link lug 268 in such a fashion that the axis of pivot pin 270 is disposed in an offset position from the rotational axis which is defined by the center or central axis of pivot shaft 216. Thus, a downward force on actuator connector 268 results in a moment on wheel block assembly 250 in the clockwise direction shown in FIG. 3.

In accordance with an other feature of the invention, a "J" shaped upper pivot link 104 is connected via pivot pin 270 to the actuator connector 268. An opposite end of upper pivot link 104 is connected via a second pivot pin 110 to a lift rod connector 112 which is threadably fastened to the lift rod 350.

In accordance with another primary feature of the invention, the symmetrical design of wheel stop 200 permits wheel stop to be actuated from either of the first or second actuator connectors 268. Such a configuration is advantageous because it permits the same wheel stop 200 to be used on either a right hand or left hand side of a support column 16.

Figure 5:
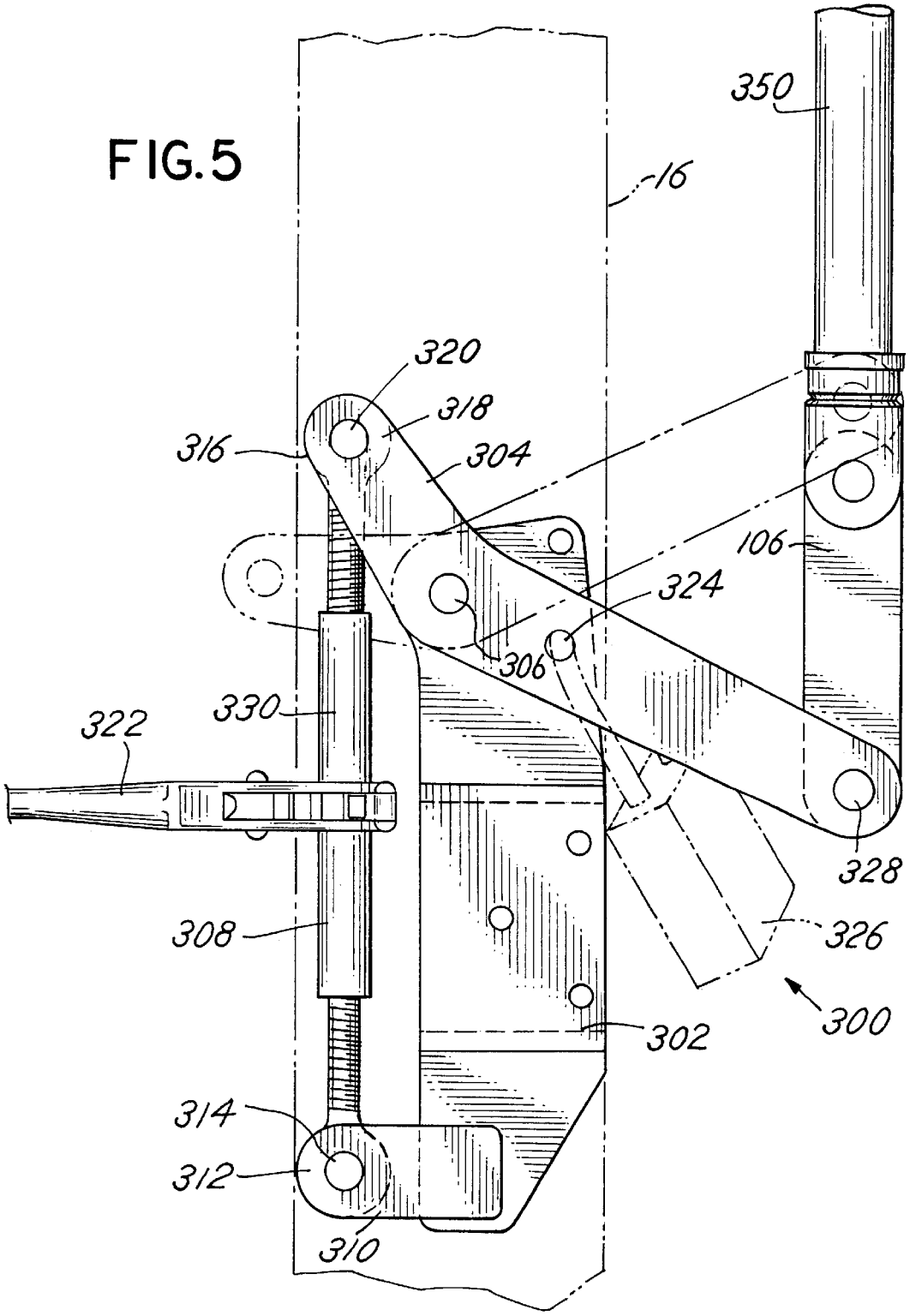
FIG. 5 is a side view of an actuator assembly according to a preferred embodiment of the present invention.
Figure 6:
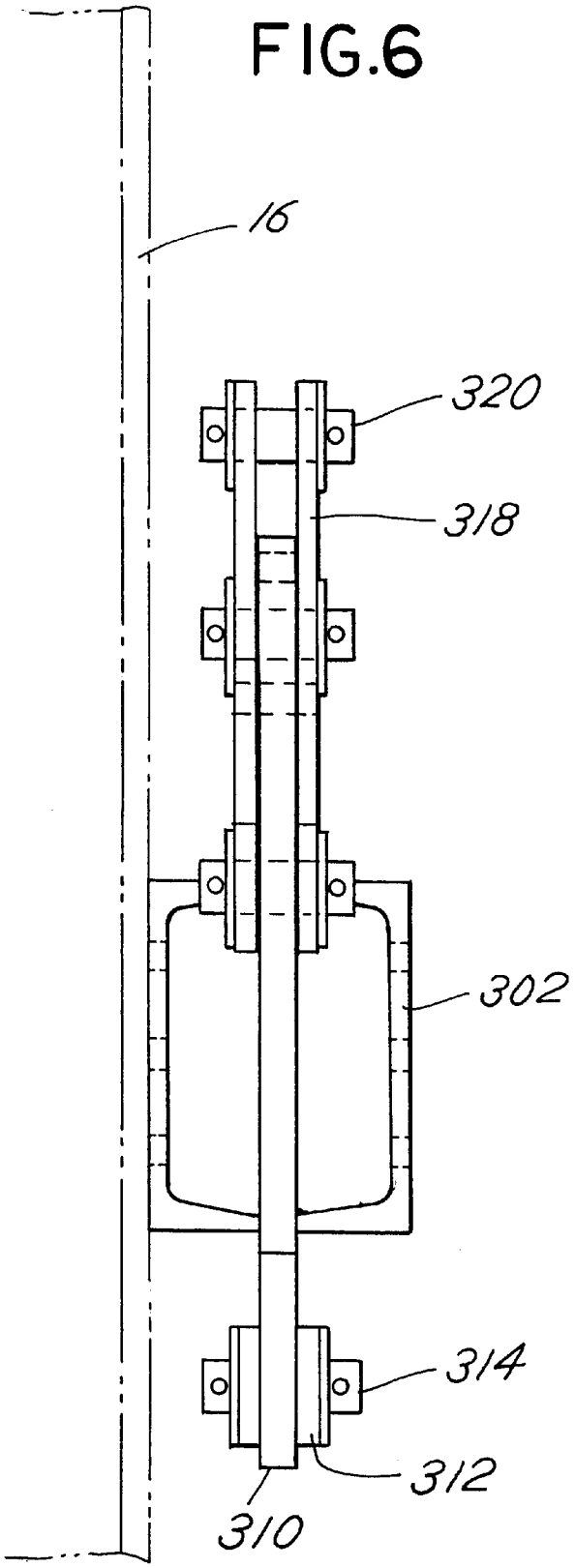
FIG. 6 is a front view of an actuator assembly according to a preferred embodiment of the present invention.

Referring now to FIGS. 5 and 6, an actuating assembly is used to actuate the lift rod 350 in a vertical manner to thereby move the wheel stop 200 from the wheel engaging position 264 to the retracted position 266 and back again. Actuating assembly 300 is comprised of a mounting bracket 302 for mounting the actuating assembly 300 to the support column 16. An actuating lever 304 is pivotably connected to the mounting bracket via an actuating lever pivot pin 306. One end of the actuating lever 304 cooperates with an extendable member 308 which may be provided in the form of an Acme screw. Extendable member 308 is provided with a lower eyelet 312 which is fastened to a lower yoke 310 using a lower pin fastener 314. In a similar fashion, an upper eyelet 316 of the extendable member 308 is fastened to a first end of the actuating lever 304 using an upper pin fastener 320. A second end of the actuating lever 304 is pivotably connected to lower pivot link 106 using a pivot pin 328.

In operation, a rachet mechanism 322 is secured to the nut 330 of Acme screw 308 to permit an operator to rotate the Acme screw number 330 to thereby extend or retract the extendable member 308. As can be seen in FIG. 5, retraction of extendable member 308 results in downward movement of the first end of actuating lever 304 and corresponding upward movement of the second end of actuating lever 304 with resulting upward movement of lift rod 350. As will be apparent to those of ordinary skill in the art, the respective lengths of the portions of actuating lever 304 on the sides of pivot pin 306 may be selected to provide appropriate leverage to permit ease of operation. In accordance with another aspect of the invention, a pair of lock apertures 324 are provided, one in actuating lever 304 and one in mounting bracket 302 to permit the use of padlock 326 to lock the actuating lever in an appropriate position. Such a configuration permits the lift rod 350 and therefore the wheel stop to be held in a wheel engaging position without potential for tampering by vandals or other unauthorized operators.

Those skilled in the art will recognize that the preferred embodiments may be altered or amended without departing from the true spirit and scope of the invention, as defined in the accompanying claims.

What is claimed is:

1. In an overhead rail system including a rail for rollably supporting a vehicle thereon, an apparatus for preventing the movement of the vehicle, the apparatus comprising:

a wheel stop for selectively engaging a wheel of the vehicle to prevent movement thereof, the wheel stop being selectively actuated from a wheel-engaging position to a retracted position;

an actuator assembly, cooperatively associated with the wheel stop, for permitting actuation of the wheel stop and being operable from a ground location beneath the rail, said actuator assembly including a lift rod and further including a pivotal lever positioned beneath said rail and operatively cooperating with said lift rod.

2. The apparatus of claim 1, wherein the wheel stop further comprises:

a base assembly for connecting the wheel stop to the rail;

a wheel block assembly pivotably cooperating with the base assembly;

an actuator connector positioned on the wheel block assembly such that a downward force on the actuator connector tends to move the wheel block assembly from the wheel-engaging position towards the retracted position.

3. The apparatus of claim 2, wherein the actuator connector is a link lug.

4. The apparatus according to claim 3, wherein the link lug is adapted to receive a pivot pin for pivotably connecting the link lug to the actuating member, the pivot pin having a central axis which is offset from the rotational axis in a direction substantially perpendicular to a plane defined by the wheel-engaging position of the wheel block assembly.

5. The apparatus of claim 1 wherein the actuator assembly comprises a "J" shaped pivot link cooperatively associated with the actuator connector.

6. The apparatus of claim 1, further comprising an actuating assembly for lifting and lowering the lift rod, the actuating assembly including means for preventing tampering with the actuator assembly.

7. In an overhead rail system including a rail for rollably supporting a vehicle thereon, an apparatus for preventing the movement of the vehicle, the apparatus comprising:

a wheel stop for selectively engaging a wheel of the vehicle to prevent movement thereof, the wheel stop being selectively actuated between the wheel engaging position and a retracted position;

an actuator assembly operatively associated with said wheel stop by permitting actuation of said wheel stop, said actuator assembly being operable from a location beneath said rail, said actuator assembly further including a lift rod for selectively moving said wheel stop between said wheel engaging position and said retracted; and a pivotal lever operatively and pivotally interconnecting and cooperating with said lift rod and said actuator assembly and for selectively moving said wheel stop between said wheel engaging position, for preventing the movement of said vehicle, and said retracted position, for allowing the movement of said vehicle.

8. The apparatus of claim 7, wherein said wheel stop further comprises:

a base assembly for connecting said wheel stop to said rail;

a wheel block assembly pivotally connected to said base assembly; and an actuator connector positioned on said wheel block assembly such that a force in one direction on the said actuator connector moves said wheel block assembly from said wheel engaging position to said retracted position and such that a reverse force on said actuator connector moves said wheel block assembly to said wheel engaging position from said retracted position.

9. The apparatus of claim 8, wherein said actuator connector comprises a link lug; and a pivot pin for pivotally connecting said link lug to said actuating member, said pivot pin having a central access which is offset from the rotational access thereof in a direction substantially perpendicular to a plane defined by the wheel engaging position of said wheel block assembly.

10. The apparatus of claim 9, wherein said actuator assembly comprises a j-shape pivot link cooperatively associated with said actuator connector.

11. In an overhead rail system including a rail for rollably supporting a vehicle thereon, an apparatus for preventing the movement of the vehicle, the apparatus comprising:

a wheel stop for selectively engaging a wheel of the vehicle to prevent movement thereof, the wheel stop being selectively actuated from a wheel-engaging position to a retracted position;

a support column for said rail, said support column having two sides;

an actuator assembly, cooperatively associated with the wheel stop, for permitting actuation of the wheel stop from a ground location beneath the rail; said actuator assembly further comprising a mounting bracket having symmetrical fastening means for fastening said mounting bracket to either, two sides of said support column.

* * * * *